US008878693B2

(12) United States Patent
Nagura et al.

(10) Patent No.: US 8,878,693 B2
(45) Date of Patent: Nov. 4, 2014

(54) DRIVER ASSISTANCE DEVICE AND METHOD OF CONTROLLING THE SAME

(75) Inventors: Michinaga Nagura, Kariya (JP); Seigou Kumabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 240 days.

(21) Appl. No.: 13/089,451

(22) Filed: Apr. 19, 2011

(65) Prior Publication Data

US 2011/0260886 A1 Oct. 27, 2011

(30) Foreign Application Priority Data

Apr. 21, 2010 (JP) ..... 2010-097932

(51) Int. Cl.

| | |
|---|---|
| ***G08G 1/09*** | (2006.01) |
| ***G08G 1/00*** | (2006.01) |
| ***G08G 1/081*** | (2006.01) |
| ***G08G 1/0967*** | (2006.01) |

(52) U.S. Cl.

CPC ..... *G08G 1/081* (2013.01); *G08G 1/096783* (2013.01)

USPC ..... 340/905; 701/117

(58) Field of Classification Search

CPC ..... G08G 1/096716–1/096791

USPC ..... 340/900–905

See application file for complete search history.

(56) References Cited

U.S. PATENT DOCUMENTS

| | | | | |
|---|---|---|---|---|
| 6,989,766 | B2 * | 1/2006 | Mese et al. | 340/907 |
| 7,605,694 | B2 * | 10/2009 | Prost-Fin et al. | 340/438 |
| 2008/0103655 | A1 * | 5/2008 | Turnbull et al. | 701/33 |
| 2009/0224942 | A1 * | 9/2009 | Goudy et al. | 340/905 |
| 2010/0020170 | A1 * | 1/2010 | Higgins-Luthman et al. | 348/135 |
| 2010/0145600 | A1 * | 6/2010 | Son et al. | 701/123 |
| 2010/0222965 | A1 * | 9/2010 | Kimura et al. | 701/41 |
| 2011/0254701 | A1 * | 10/2011 | Yamada | 340/905 |

FOREIGN PATENT DOCUMENTS

| | | |
|---|---|---|
| JP | A-05-128399 | 5/1993 |
| JP | A-05-128400 | 5/1993 |
| JP | A-08-329384 | 12/1996 |
| JP | A-2000-357293 | 12/2000 |
| JP | A-2002-373396 | 12/2002 |
| JP | A-2004-252718 | 9/2004 |
| JP | A-2004-258867 | 9/2004 |
| JP | A-2008-084219 | 4/2008 |

(Continued)

OTHER PUBLICATIONS

Office Action mailed Feb. 28, 2012 in corresponding JP Application No. 2010-097932 (and English translation).

*Primary Examiner* — Brian Zimmerman
*Assistant Examiner* — Thomas McCormack
(74) *Attorney, Agent, or Firm* — Posz Law Group, PLC

(57) ABSTRACT

A driver assistance device to be disposed in a vehicle includes a traffic signal information acquiring section, an intersection distance acquiring section, a target speed calculating section, and an outputting section. The traffic signal information acquiring section acquires traffic signal information that includes current and future lighting colors and lighting times of respective lighting colors of a traffic signal located in a traveling direction of the vehicle. The intersection distance acquiring section acquires an intersection distance between the vehicle and an intersection at which the traffic signal is located. The target speed calculating section calculates a target speed range to enable the vehicle to enter the intersection in a state where the lighting color of the traffic signal is green. The outputting section outputs the target speed range.

16 Claims, 8 Drawing Sheets

(56) References Cited

FOREIGN PATENT DOCUMENTS

| | | |
|---|---|---|
| JP | A-2008-112255 | 5/2008 |
| JP | A-2008-296783 | 12/2008 |
| JP | A-2008-302819 | 12/2008 |
| JP | A-2008-302849 | 12/2008 |
| JP | A-2009-3577 | 1/2009 |
| JP | A-2009-15510 | 1/2009 |
| JP | A-2009-70000 | 4/2009 |
| JP | A-2009-87062 | 4/2009 |
| JP | A-2009-104543 | 5/2009 |
| JP | A-2009-169770 | 7/2009 |
| JP | A-2009-173093 | 8/2009 |
| JP | A-2009-245326 | 10/2009 |

* cited by examiner

DRIVER ASSISTANCE DEVICE AND METHOD OF CONTROLLING THE SAME

CROSS REFERENCE TO RELATED APPLICATIONS

The present application is based on and claims priority to Japanese Patent Application No. 2010-97932 filed on Apr. 21, 2010, the contents of which are incorporated in their entirety herein by reference.

BACKGROUND OF THE INVENTION

1. Field of the Invention

The present invention relates to a driver assistance device and a driver assistance system for assisting a driving operation by a driver of a vehicle. The present invention also relates to a method of controlling a driver assistance device and a computer readable medium that includes instructions including the method of controlling the driver assistance device.

2. Description of the Related Art

JP-A-2009-15110 discloses a driver assistance device that receives traffic signal information including a schedule of lighting colors of a traffic signal from an external device, determines whether a current speed enables a subject vehicle in which the driver assistance device is disposed to cross an intersection on a green light, and outputs a warning when the driver assistance device determines that the current speed does not enable the subject vehicle to cross the intersection.

The above-described driver assistance system outputs the warning only based on whether the current speed enables the subject vehicle to cross an intersection on a green light. Thus, the driver assistance system cannot contribute to improve fuel consumption and to reduce traffic jams.

SUMMARY OF THE INVENTION

In view of the foregoing problems, it is an object of the present invention to provide a driver assistance device and a driver assistance system that can contribute to improve fuel consumption and to reduce traffic jams. Other objects of the present invention are to provide a method of controlling a driver assistance device and a computer readable medium that includes instructions including the method of controlling the driver assistance device.

According to a first aspect of the present invention, a driver assistance device to be disposed in a vehicle for assisting a driving operation by a driver of the vehicle includes a traffic information acquiring section, an intersection distance acquiring section, a target speed calculating section, and an outputting section. The traffic signal information acquiring section acquires traffic signal information that includes current and future lighting colors and lighting times of respective lighting colors of a traffic signal located in a traveling direction of the vehicle. The intersection distance acquiring section acquires an intersection distance between the vehicle and an intersection at which the traffic signal is located. The target speed calculating section calculates a target speed range to enable the vehicle to enter the intersection in a state where the lighting color of the traffic signal is green. The outputting section outputs the target speed range.

The driver assistance system calculates the target speed range to enable the vehicle to enter the intersection in a state where the lighting color of the traffic signal is green and outputs the target speed range. Thus, by controlling the speed of the vehicle within the target speed range, the vehicle can enter the intersection on the green light without stopping. As a result, the driver assistance device can contribute to improve fuel consumption and to reduce traffic jams.

According to a second aspect of the present invention, a driver assistance system includes the driver assistance device according to the first aspect and a roadside device that is communicatable with the driver assistance device. The roadside device includes a traffic signal information transmitting section configured to transmit the traffic signal information to the driver assistance device.

According to a third aspect of the present invention, a method of controlling a driver assistance device to be disposed in a vehicle includes acquiring traffic signal information that includes current and future lighting colors and lighting times of respective lighting colors of a traffic signal located in a traveling direction of the vehicle, acquiring an intersection distance between the vehicle and an intersection at which the traffic signal is located, calculating a target speed range to enable the vehicle to enter the intersection in a state where the lighting color of the traffic signal is green, and outputting the target speed range.

In the above-described method, the target speed range to enable the vehicle to enter the intersection in a state where the lighting color of the traffic signal is green is output. Thus, by controlling the speed of the vehicle within the target speed range, the vehicle can enter the intersection on the green light without stopping. Therefore, the above-described method can contribute to improve fuel consumption and to reduce traffic jams.

According to a fourth aspect of the present invention, a computer readable medium includes instructions being executed by a computer. The instructions include the method of controlling the driver assistance device according to the third aspect, and the method is computer-implemented.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

Figure 1:
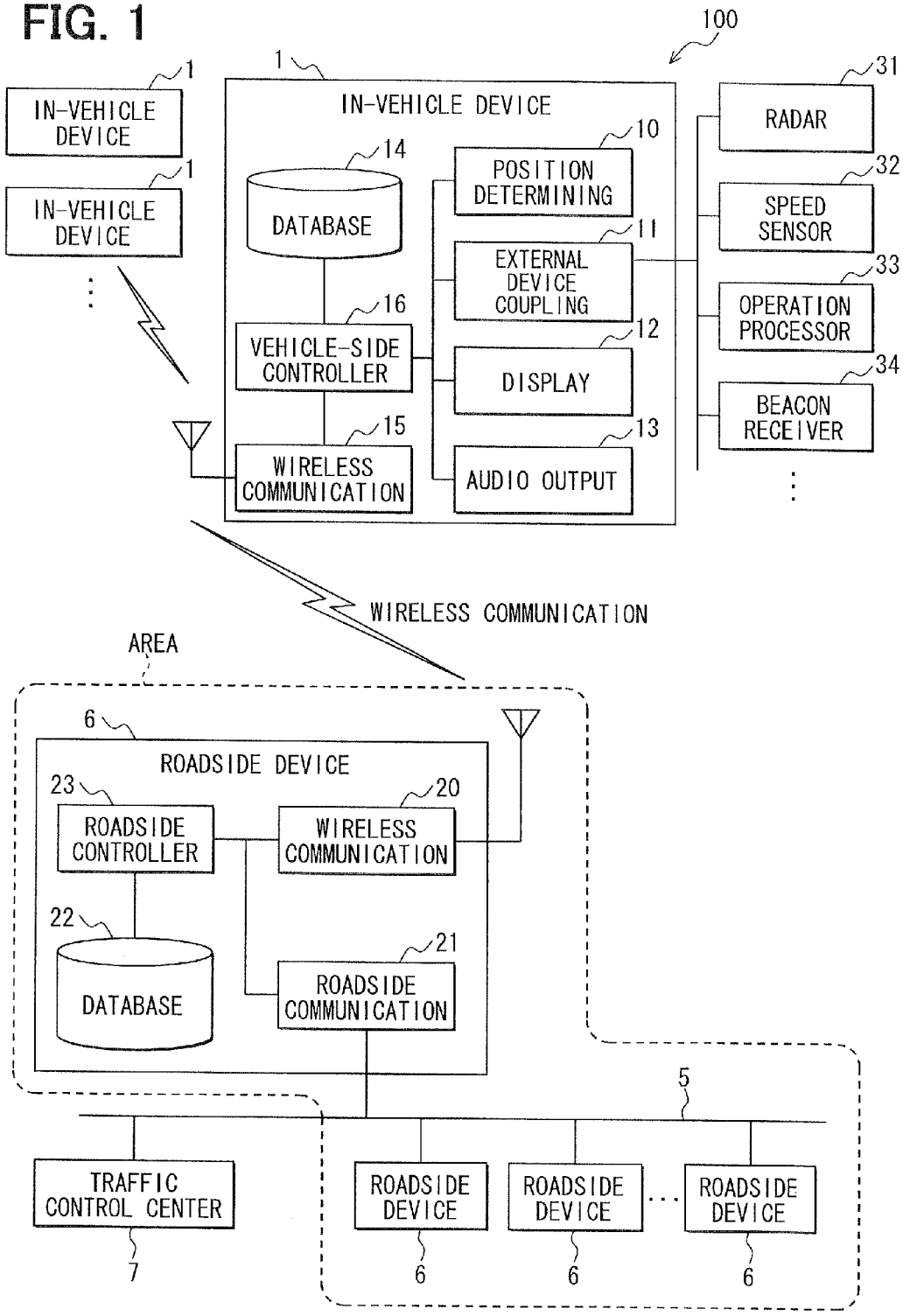
FIG. 1 is a block diagram showing a driver assistance system according to an embodiment of the present invention.

A driver assistance system 100 according to an embodiment of the present invention will be described with reference to FIG. 1. The driver assistance system 100 includes an in-vehicle device 1 and a roadside device 6. The in-vehicle device 1 is disposed on each of a plurality of vehicles traveling on a road. The in-vehicle device 1 can function as a driver control device. The roadside device 6 is provided for each traffic signal located at intersections.

The in-vehicle device 1 disposed in each vehicle can make vehicle-to-vehicle communications with in-vehicle devices 1 disposed in other vehicles. Because the in-vehicle device 1 disposed in each vehicle has the same configuration, a detail configuration of only one in-vehicle device 1 is shown in FIG. 1. Hereafter, one of the vehicles in which the in-vehicle device 1 is disposed is referred to as a subject vehicle.

The in-vehicle device 1 includes a position determining portion 10, an external device coupling portion 11, a display portion 12, an audio output portion 13, a database 14, a wireless communication portion 15, and a vehicle-side controller 16.

The position determining portion 10 determines a current position of a vehicle and a traveling direction of the vehicle based on detection signals from, for example, a speed sensor 32, a light beacon receiver 34, a global positioning system (GPS) receiver (not shown), and a gyroscope. The position determining portion 10 outputs determined data to the vehicle-side controller 16. A light beacon transmitter is located short of an intersection. From the light beacon transmitter, the light beacon receiver 34 receives information about a distance to the intersection, information about a current position (position of the light beacon transmitter) and traffic information.

The external device coupling portion 11 is an interface for communicating between various devices disposed in the vehicle such as a radar 31, the speed sensor 32, the light beacon receiver 34, and other electronic control unit (ECU) such as an operation processor 33. The external device coupling portion 11 outputs data of vehicle information transmitted from each device to the vehicle-side controller 16.

The display portion 12 includes a display surface, such as a liquid crystal panel, for displaying image. The display portion 12 displays various driver assistance images thereon. The display surface is arranged so as to be visible from a driver seat of the vehicle.

Figure 2:
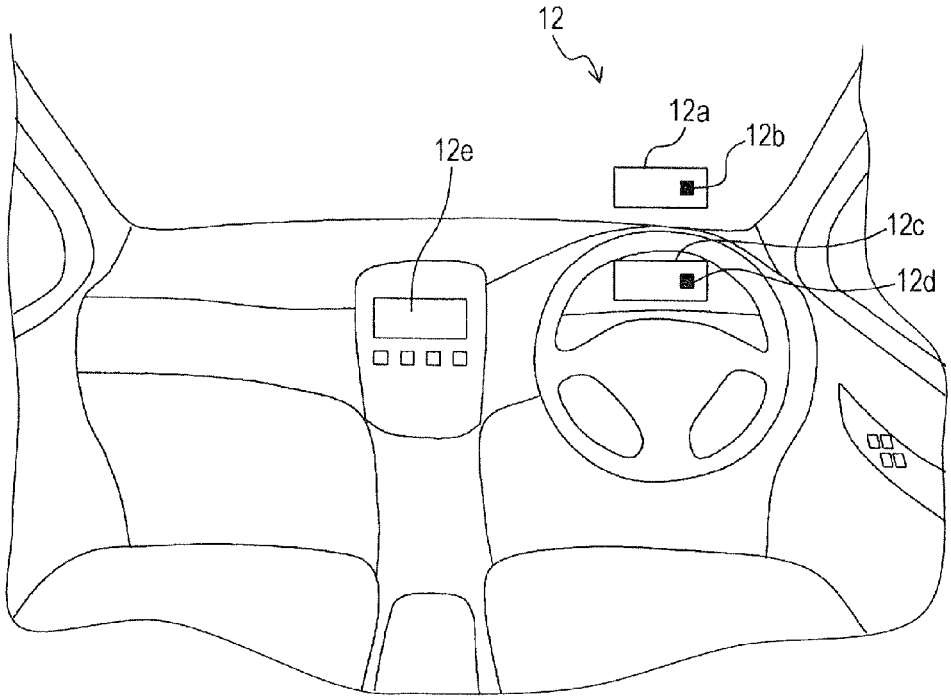
FIG. 2 is a diagram showing examples of a display portion.

As shown in FIG. 2, the display portion 12 is configured as, for example, a head-up display portion 12*a*, a meter display portion 12*c*, and a liquid crystal display portion 12*e* of a navigation device. The head-up display portion 12*a* can display an acceleration and deceleration instruction image 12*b*. The meter display portion 12*c* includes a light-emitting body 12*d* having a predetermined shape. The light-emitting body 12*d* can be lighted up and can blink. The liquid crystal display portion 12*e* can display an image having a predetermined shape in a manner similar to the head-up display portion 12*a*.

A light-emitting part such as the acceleration and deceleration instruction image 12*b* and the light-emitting body 12*d* is configured to selectively emit one of a plurality of colors including, for example, green and red. In the following description, it is assumed that the in-vehicle device 1 includes only the head-up display portion 12*a* as the display portion 12 for ease of explanation.

The audio output portion 13 is an audio output device that includes, for example, a speaker for outputting audio signals. The audio output portion 13 outputs various audio assist for a driver based on a control signal from the vehicle-side controller 16. The database 14 is a storage device for storing area data received from the roadside devices 6 located at various positions on a roadside.

The area data includes traffic signal information of each traffic signal in a predetermined area that includes a plurality of intersections at which a plurality of traffic signals is respectively located. The traffic signal information of each traffic signal includes current and future lighting colors, lighting times of respective lighting colors, that is, a schedule of lighting signal colors, and a position of the traffic signal. The area data stored in the database 14 is used for a driver assist control when the subject vehicle passes through the traffic signal included in the area data.

The wireless communication portion 15 is a communication device for making two-way wireless communications with wireless communication portions in other vehicles and the roadside devices 6 located on the roadside, that is, for making vehicle-to-vehicle communications and road-to-vehicle communications. A communication mode used for the road-to-vehicle communications includes a dedicated short range communications (DSRC) used, for example, in electronic toll collection (ETC), which is a registered trademark in Japan, and techniques of an electric wave beacon and a light beacon used, for example, in a vehicle information communication system (VICS), which is a registered trademark in Japan. The road-to-vehicle communication may also use an electric wave in a 700 MHz band, a use classification of which will be reorganized after an end of an analog television broadcasting in 2011 in Japan. The electric wave in the 700 MHz band is longer than an electric wave in 5.8 GHz used in the DSRC, and diffracts easily. Thus, the electric wave in the 700 MHz band can be suitably used for communicating from a shadow of a building in built-up areas.

The wireless communication portion 15 outputs the position information of the subject vehicle generated by the position determining portion 10 and information about a vehicle group based on control signals from the vehicle-side controller 16.

The vehicle-side controller 16 may be a microcomputer that includes a central processing unit (CPU), a read only memory (ROM), and a random access memory (RAM). The vehicle-side controller 16 controls each component in the in-vehicle device 1. The vehicle-side controller 16 executes process of acquiring and updating the area data with the road-to-vehicle communications and various processes for the driver assistance based on programs stored, for example, in the ROM.

In the driver assistance system, the vehicle-side controller 16 provides the information about the traffic signal which the subject vehicle crosses next and carries out a traveling control for crossing an intersection smoothly. In particular, the vehicle-side controller 16 according to the present embodiment carries out a vehicle group control.

The vehicle group control includes a line traveling control and a parallel traveling control so that the subject vehicle travels in the same direction with other vehicles. In the line traveling control, the vehicle-side controller 16 controls the subject vehicle so that the subject vehicle moves in a manner similar to a lead vehicle of a line or a vehicle in front of the subject vehicle. In the parallel traveling control, the vehicle side controller 16 controls the subject vehicle so that the subject vehicle moves in parallel with other vehicle.

In the vehicle group control, the vehicle-side controller 16 outputs instructions such as acceleration, deceleration, and turning based on the position information of other vehicles acquired with the vehicle-to-vehicle communications and the position information of the subject vehicle acquired from the position determining portion 10. In other words, the vehicle-side controller 16 outputs the instructions based on the movement of other vehicles in the vehicle group so that the subject vehicle follows the movement of other vehicles.

Based on the instructions from the vehicle-side controller 16, the display portion 12 or the audio output portion 13 may output an image or an audio assist so that the subject vehicle travels at a predetermined speed. The operation processor 33 includes an electronic control unit. The operation processor 33 may also control each component such as an accelerator, a brake, and a light of the subject vehicle based on the instructions from the vehicle-side controller 16, and thereby the subject vehicle operates uniformly in the vehicle group.

Because a technique regarding a process of controlling the subject vehicle to follow other vehicles in the vehicle group is known, a description about the technique is omitted. The vehicle-side controller 16 also detects information about the vehicle group. The vehicle-side controller 16 determines whether the subject vehicle is a lead vehicle in the vehicle group, the subject vehicle is an end vehicle in the vehicle group, or the subject vehicle is a middle vehicle between a lead vehicle and an end vehicle based on the position information of the subject vehicle and other vehicles. The vehicle-side controller 16 may use a received result of the light beacon for making the above-described determination.

The vehicle-side controller 16 determines the position of each vehicle by repeatedly transmitting a vehicle ID for identifying of the subject vehicle and the position information of the subject vehicle to other vehicles in the vehicle-to-vehicle communications. Based on the position of each vehicle, for example, the lead vehicle may be set to a representative vehicle for controlling the vehicle group and may store the information about the vehicle group.

The information of the vehicle group is stored in the database 14 and is shared with other vehicles in the vehicle group by exchanging the information through the wireless communication portion 15.

The roadside device 6 includes a wireless communication portion 20, a roadside communication portion 21, a database 22, and a roadside controller 23. The wireless communication portion 20 is a communication device for making road-to-vehicle communications with the in-vehicle device 1 disposed in a vehicle traveling on a road. The communication mode used for the road-to-vehicle communication is same as the communication mode of the in-vehicle device 1.

The roadside communication portion 21 is a communication device for communicating with other roadside device 6 associated with a traffic signal located at other position in the predetermined area and communicating with a traffic control center 7 that provides traffic information. The communication between the roadside communication portion 21 and the traffic control center 7 may be performed with wired or wireless communication.

The database 22 is a storage device for storing area data of traffic signal information of a plurality of traffic signals in the predetermined area. The database 22 is, for example, a rewritable nonvolatile memory such as a flash memory and a hard disk drive.

The roadside controller 23 may be a microcomputer that includes a CPU, a ROM, and a RAM. The vehicle-side controller 16 controls each component in the in-vehicle device 1. The roadside controller 23 periodically reads the area data from the database 22 and wirelessly transmits the area data to the in-vehicle device 1 through the wireless communication portion 20. The roadside controller 23 can function as a traffic signal information transmitting portion.

Figure 3A:
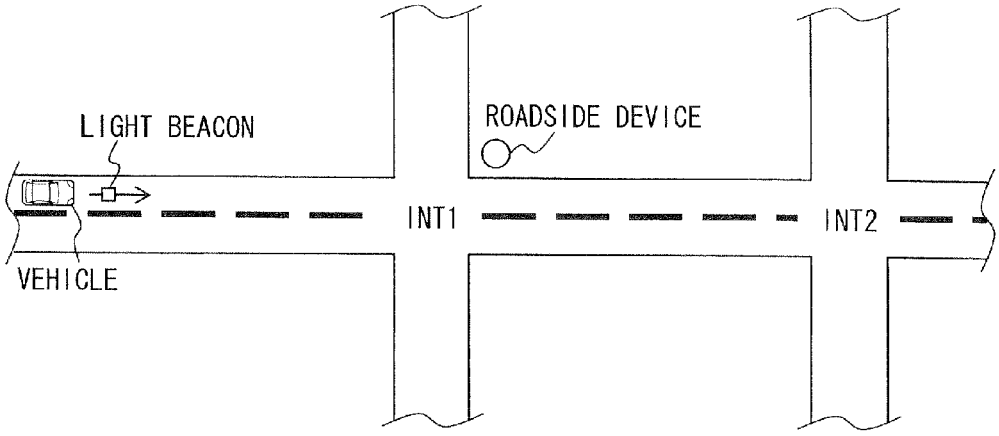
FIG. 3A and FIG. 3B are diagrams for explaining an outline of the driver assistance system according to the embodiment.

In the driver assistance system 100 according to the present embodiment, for example, as shown in FIG. 3A, when the subject vehicle in which the in-vehicle device 1 is disposed approaches a first intersection (INT1) and a second intersection (INT2), the in-vehicle device 1 receives the traffic signal information of each intersection from the roadside device 6 and executes a process for informing a speed range to enable the subject vehicle to cross the intersections without stopping when possible.

Figure 3B:
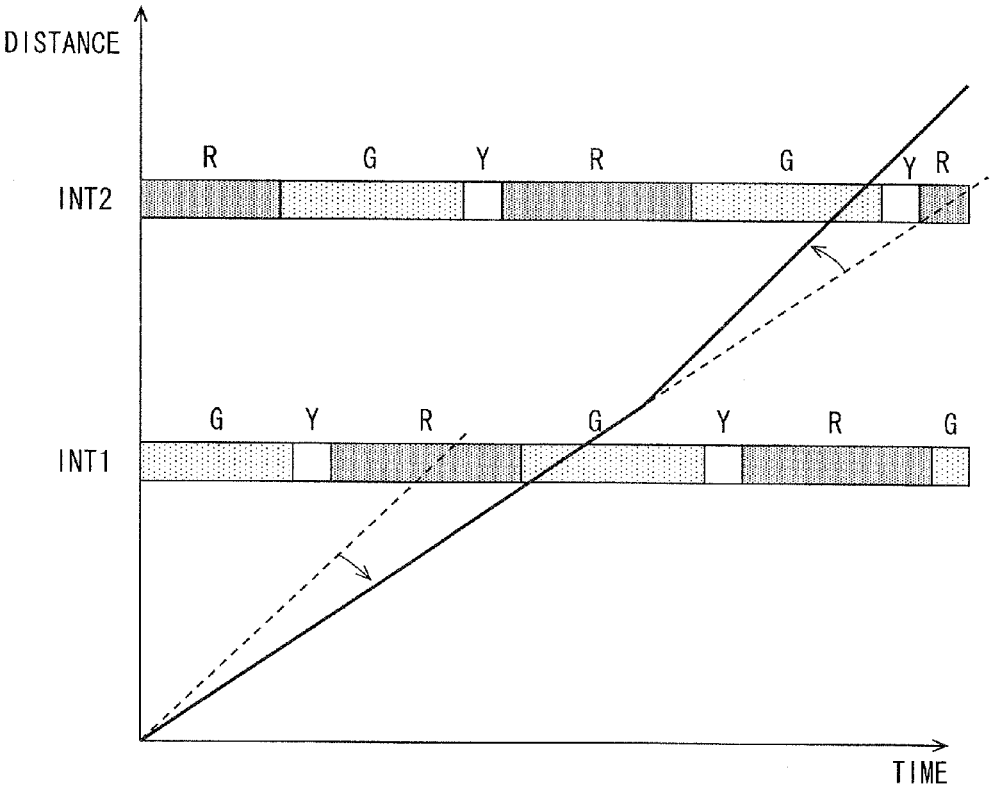

As shown in FIG. 3B, in a case where the subject vehicle will arrive at the first intersection or the second intersection on a red light at a current speed (see dashed lines), the in-vehicle device 1 prompts a driver to accelerate or decelerate the subject vehicle so that the subject vehicle can arrive at the first intersection or the second intersection on a green light. If there is a speed at which the subject vehicle can cross a plurality of intersections on a green light, the in-vehicle device 1 prompts the driver to drive the subject vehicle at the speed.

Figure 4:
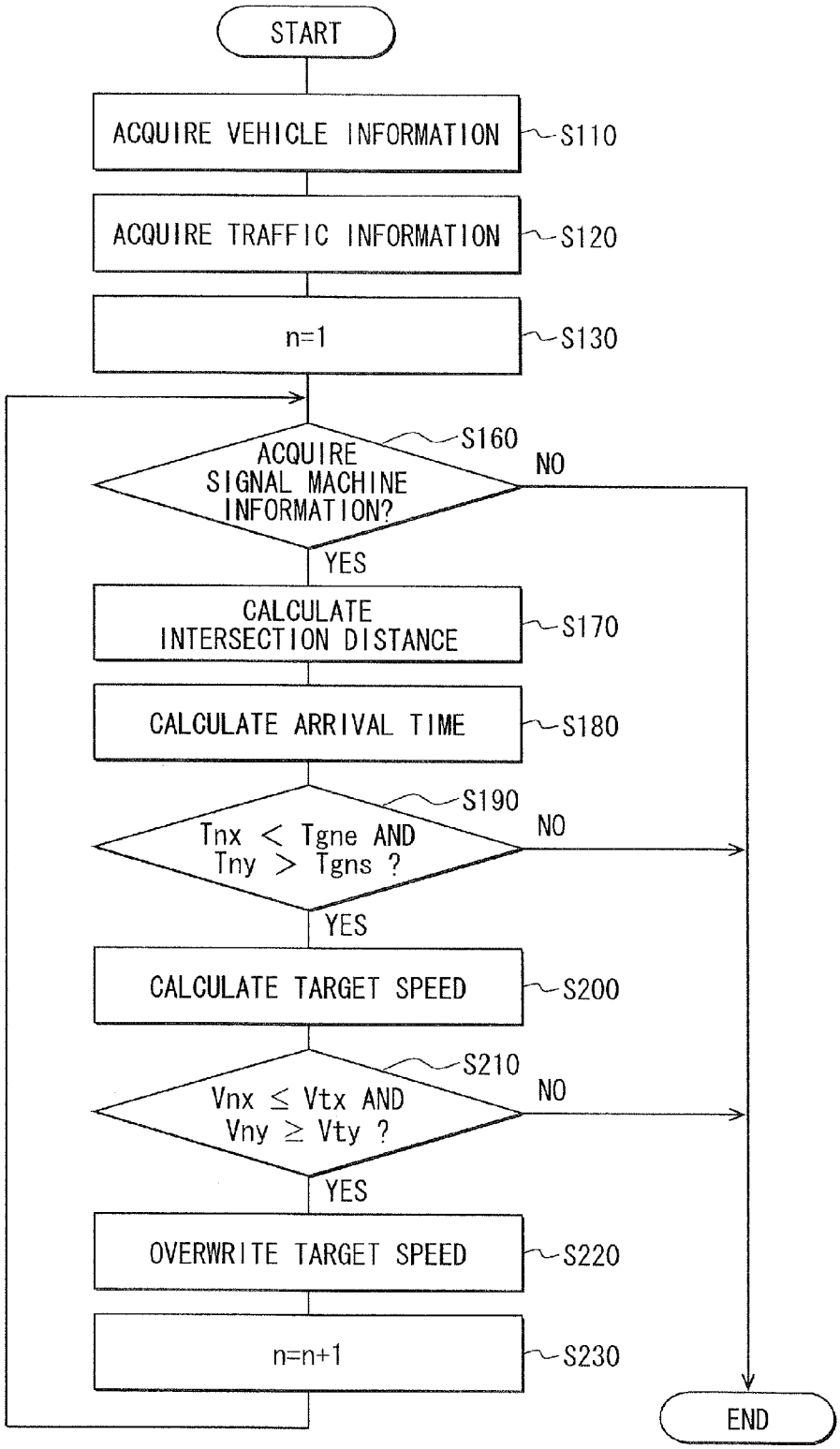
FIG. 4 is a flowchart showing a target speed setting process.
Figure 5:
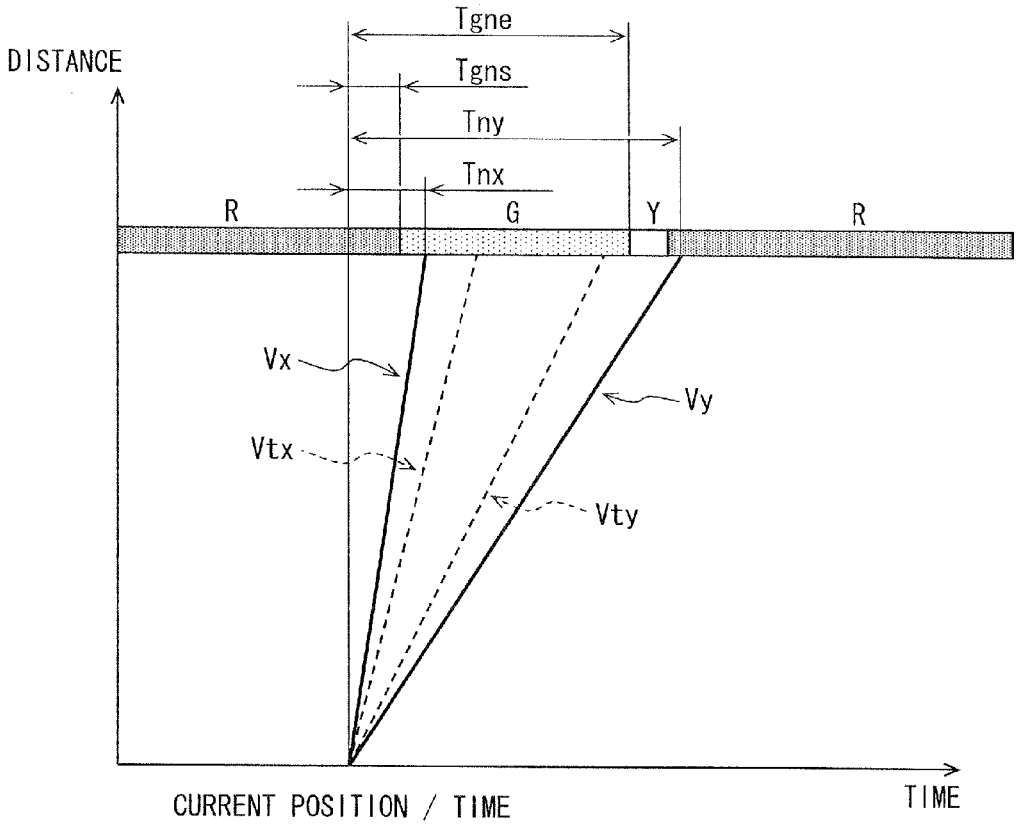
FIG. 5 is a diagram showing a relationship between a time and a distance.

A target speed setting process performed by the vehicle-side controller 16 in the in-vehicle device 1 will be described with reference to FIG. 4. The vehicle-side controller 16 starts the target speed setting process when the in-vehicle device 1 is powered on and repeats the target speed setting process at a predetermined period, for example, every 100 ms to 500 ms.

At S110, the vehicle-side controller 16 acquires vehicle information about the subject vehicle and other vehicle. The process at S110 may be performed by a speed acquiring section and a front vehicle acquiring section provided in the vehicle-side controller 16. The vehicle information includes the position of the subject vehicle, the speed of the subject vehicle, the information about the vehicle ground, information about whether there is a front vehicle traveling ahead of the subject vehicle. The information about the front vehicle can be determined based on the information about the vehicle group or a detection result by the radar 31.

At S120, the vehicle-side controller 16 acquires the traffic information. The process at S120 may be performed by a traffic signal information acquiring section and a speed limit acquiring section provided in the vehicle-side controller 16. During the process at S120, the vehicle-side controller 16 acquires the traffic information from the light beacon transmitter and the roadside device 6, and the traffic information includes information about speed limit of a road on which the subject vehicle travels and information about a traffic signal located at an intersection which the subject vehicle approaches.

At S130, the vehicle-side controller 16 sets a variable "n" to 1. The variable "n" indicates an n-th closest intersection in the traveling direction of the subject vehicle among intersections where traffic signals are located respectively. An intersection of n=1 indicates the closest intersection from the subject vehicle.

At S160, the vehicle-side controller 16 determines whether traffic signal information about an n-th intersection is acquired as the vehicle information.

If the vehicle-side controller 16 determines that the traffic signal information of the n-th intersection is not acquired, which corresponds to "NO" at S160, the vehicle-side controller 16 ends the target speed setting process. If the vehicle-side controller 16 determines that the traffic signal information of the n-th intersection is acquired, which corresponds to "YES" at S160, the process proceeds to S170. At S170, the vehicle-side controller 16 calculates a distance to the n-th intersection (intersection distance). The process at S170 may be performed by an intersection distance acquiring section, a beacon acquiring section, or a latitude and longitude acquiring section provided in the vehicle-side controller 16.

During the process at S170, the vehicle-side controller 16 calculates the intersection distance based on an intersection distance and the position of the light beacon transmitter included in information acquired before through the light beacon receiver 34 and a traveling distance of the subject vehicle after the vehicle-side controller 16 acquires the information from the light beacon transmitter. The vehicle-side controller 16 can calculate the traveling distance of the subject vehicle with the traveling speed and the traveling time of the subject vehicle.

In a case where the light beacon receiver 34 is not provided or a case where a predetermined time has elapsed after the vehicle-side controller 16 receives the information from the light beacon transmitter, the vehicle-side controller 16 may calculate the intersection distance based on the information about the latitude and the longitude of the intersection at which the traffic signal is located and the current position (latitude and longitude) of the subject vehicle detected by the position determination portion 10. The calculated intersection distance is stored in a memory such a random access memory (RAM) and is read in the following process.

At S180, the vehicle-side controller 16 calculates an arrival time when the subject vehicle arrives at the n-th intersection. The process at S180 may be performed by a prohibiting section provided in the vehicle-side controller 16. The following definitions are used in the following description.

Vx: a maximum speed

Vy: a minimum speed

Vn: a speed at entering the n-th intersection

Dn: a distance to the n-th intersection

D0: a distance to a position where the subject vehicle traveling at the speed Vn stops at a deceleration rate R Tn: a time to when the subject vehicle traveling at the speed Vn stops at the deceleration rate R Tnx: a time to when the subject vehicle traveling at the maximum speed Vx arrives at the n-th intersection (the earliest time when the subject vehicle arrives at the n-th intersection)

Tny: a time to when the subject vehicle traveling at the minimum speed Vy arrives at the n-th intersection (the latest time when the subject vehicle arrives at the n-th intersection)

Tgns: a time to when the traffic signal at the n-th intersection turns green (Tgs is 0 when the traffic signal is already green)

Tgne: a time to when a green light of the traffic signal at the n-th intersection ends Vnx: a maximum speed for crossing the n-th intersection on a green light Vny: a minimum speed for crossing the n-th intersection on a green light Vtx: a maximum target speed Vty: a minimum target speed R: a predetermined deceleration rate The time Tnx to when the subject vehicle traveling at the maximum speed Vx arrives at the n-th intersection and the time Tny to when the subject vehicle traveling at the minimum speed Vy arrives at the n-th intersection can be expressed by expressions (1) and (2).

$$Tnx=Dn/Vx \tag{1}$$

$$Tny=Dn/Vy \tag{2}$$

The maximum speed Vx is a traveling speed of a vehicle in front of the subject vehicle or the speed limit of the road on which the subject vehicle travels, which is lower. The minimum speed Vy is a speed that does not disturb a traffic stream. For example, the minimum speed Vy is 30 km/h.

At S190, the vehicle-side controller 16 determines whether at least a part of the arrival time from the time Tnx to the time Tny is within a green light period from the time Tgns to the time Tgne. In other words, the vehicle-side controller 16 determines whether the following expression (3) is satisfied.

$$Tnx<Tgne \text{ and } Tny>Tgns \tag{3}$$

When the expression (3) is not satisfied, which corresponds to "NO" at S190, the vehicle-side controller 16 ends the target speed setting process because it is impossible for the subject vehicle to cross the n-th intersection without stopping. When the expression (3) is satisfied, which corresponds to "YES" at S190, it is possible for the subject vehicle to cross the n-th intersection without stopping. Thus, at S200, the vehicle-side controller 16 calculates the target speed.

When n=1, the vehicle-side controller 16 calculates a target speed range, that is, a maximum speed V1x and a minimum speed V1y to enable the subject vehicle to enter the first intersection on a green light from following expressions (4) and (5). In a case where the subject vehicle approaches the intersection in transition of the lighting color from red to green, the vehicle-side controller 16 calculates the target speed range to enable the vehicle to arrive at a position at a predetermined distance short of the traffic signal when the lighting color turns to green, and the predetermined distance depends on the traveling speed of the vehicle.

Figure 6A:
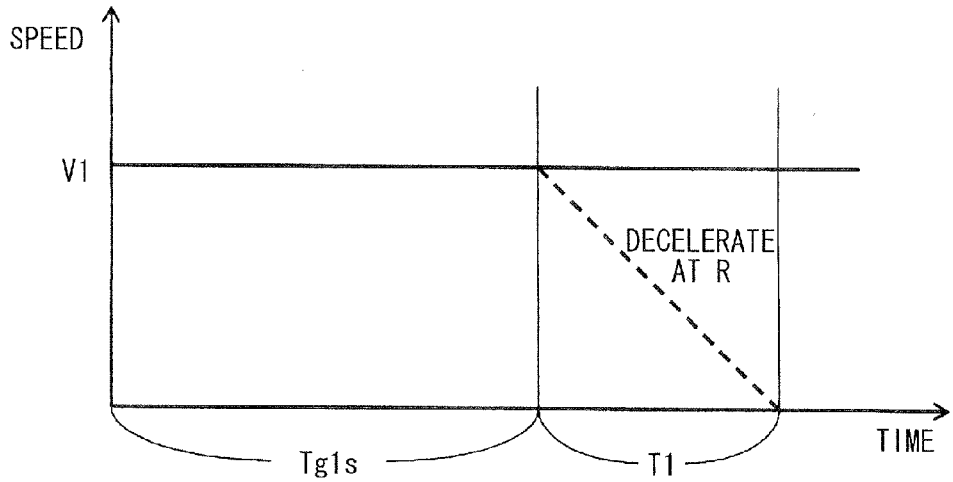
FIG. 6A and FIG. 6B are diagrams for explaining a process of setting a target speed to enable a subject vehicle to stop at a stop line.
Figure 6B:
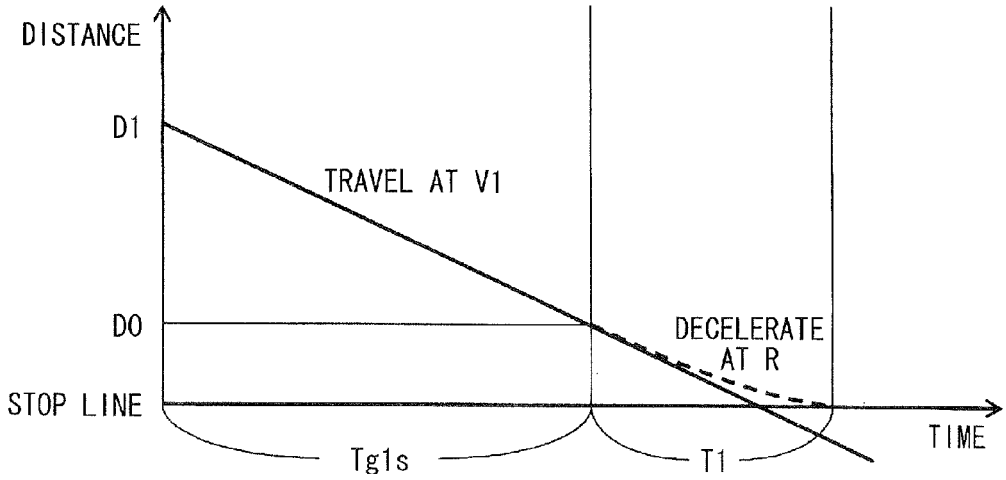

From relationships of:

$$D0=V1/2R$$

$$T1=V1/R$$

$$(D1-D0)/V1=Tg1s,$$

in a case where the target speed is set so that the traffic signal turns from red to green when the subject vehicle is decelerated at the deceleration rate R and stops at a distance D0, which is short of the traffic signal as shown in FIG. 6, the expressions (4) and (5) are obtained.

$$V1x=\min(((R^2Tg1s^2+2RD1)^{1/2}-RTg1s),Vx) \tag{4}$$

$$V1y=\max((D1/Tg1e),Vy) \tag{5}$$

In the expression (4), the maximum speed V1*x* is the former member or the latter member divided by the comma "," which is smaller. In the expression (5), the minimum speed V1*y* is the former member or the latter member divided by a comma "," which is greater.

Then, as shown in expressions (6) and (7), the maximum speed V1*x* and the minimum speed V1*y* are set to be initials values for defining a range of the target speed.

$$Vtx=V1x \tag{6}$$

$$Vty=V1y \tag{7}$$

When n=2 or greater, the maximum target speed Vnx and the minimum target speed Vny are calculated with following expressions (8) and (9).

$$Vnx=\min(((R^2Tgns^2+2RDn)^{1/2}-RTgns),Vx) \tag{8}$$

$$Vny=\max((Dn/Tgne),Vy) \tag{9}$$

The target speed range is calculated as described above. The speed Vnx and the speed Vny in the expressions (8) and (9) are the target speeds in a case where the subject vehicle crosses only the n-th intersection. Thus, at S210, the vehicle-side controller 16 determines whether the calculated target speeds are within a range of the target speeds set for the (n−1)-th intersection from following expression (10). In other words, the vehicle-side controller 16 determines whether the subject vehicle can cross the (n−1)-th intersection at the target speed for the n-th intersection. The process at S210 may be performed by a prohibiting section provided in the vehicle-side controller 16.

$$Vnx\leq Vtx \text{ and } Vny\geq Vty \tag{10}$$

The subject vehicle cannot cross the n-th intersection at a constant speed unless the expression (10) is not satisfied. When the expression (10) is satisfied, the subject vehicle can cross intersections to the n-th intersection at a constant speed. In other words, when the target speeds for the n-th intersection are within the target speed range for the (n−1)-th intersection, which corresponds to "YES" at S210, the process proceeds to S220. At S220, the vehicle-side controller 16 overwrites the target speeds calculated before with the target speeds calculated in the present process. The process at S220 may be performed by an outputting section provided in the vehicle-side controller 16.

The vehicle-side controller 16 overwrites the target speeds with selecting the maximum target speed Vtx and the minimum target speed Vty based on following expressions (11) and (12).

$$Vtx=\min(Vnx, Vtx) \tag{11}$$

$$Vty=\max(Vny, Vty) \tag{12}$$

After the vehicle-side controller 16 finishes the process at S220, the vehicle-side controller 16 increments the variable "n" by 1 at S230, and the vehicle-side controller 16 repeats the process from S160 for the (n+1)-th intersection.

When the target speeds for the n-th intersection are not within the target speed range for the (n−1)-th intersection, which corresponds to "NO" at S210, the vehicle-side controller 16 ends the target speed setting process.

Figure 7:
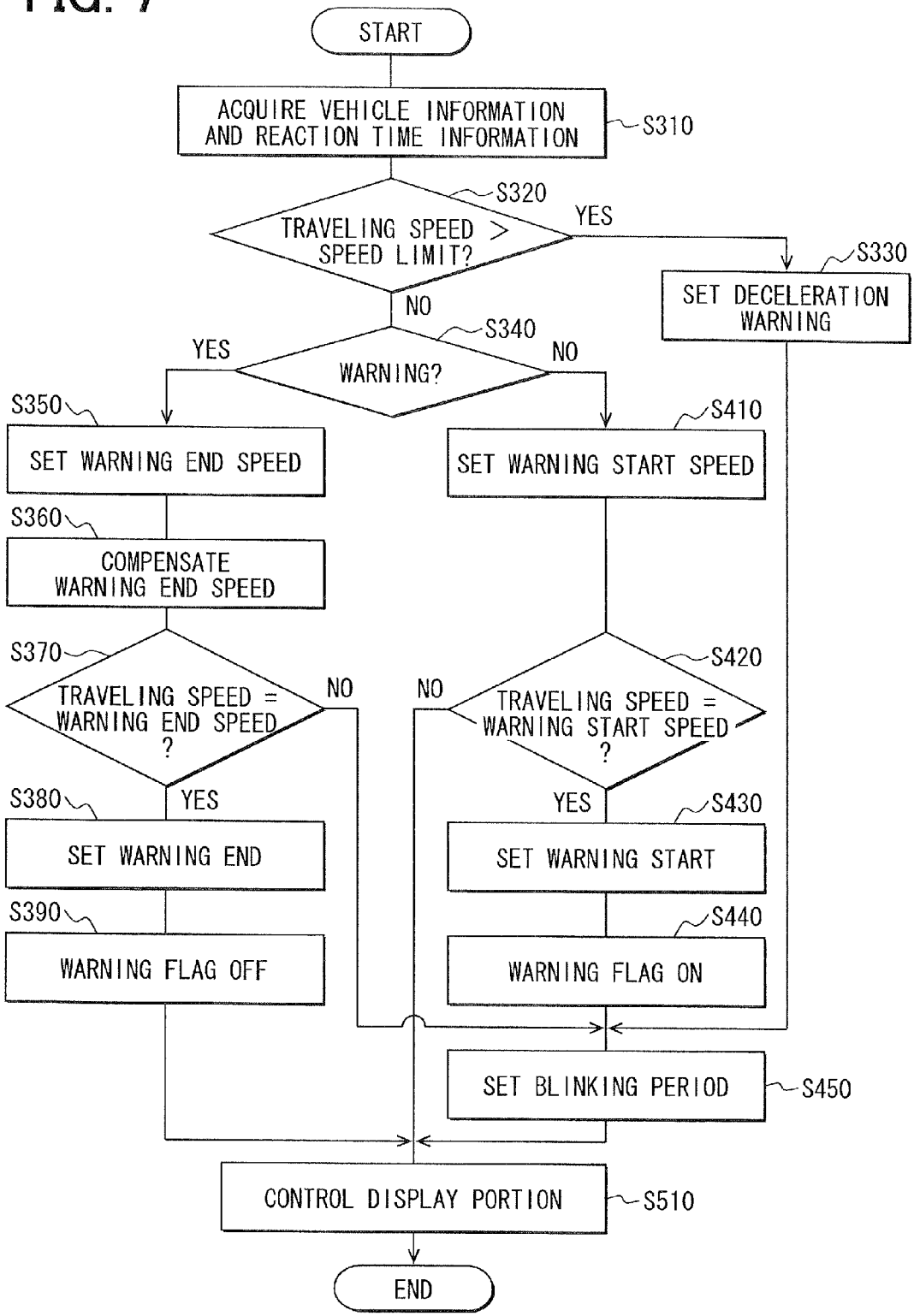
FIG. 7 is a flowchart showing a warning process.

Next, a warning process for warning a driver of the subject vehicle so that the subject vehicle can enter an intersection in a state where the traffic signal is green will be described with reference to FIG. 7. The warning process may be performed by a warning section provided in the vehicle-side controller 16.

When the target speeds for the n-th intersection are not within the target speed range for the (n−1)-th intersection, which corresponds to "NO" at S210, the vehicle-side controller 16 ends the target speed setting process. Next, a warning process for warning a driver of the subject vehicle so that the subject vehicle can enter an intersection in a state where the traffic signal is green will be described with reference to FIG. 7. The warning process may be performed by a first warning section provided in the vehicle-side controller 16.

The vehicle-side controller 16 executes the warning process in parallel with the target speed setting process. For example, the vehicle-side controller 16 starts the warning process when the in-vehicle device 1 is power on and repeats the warning process at a predetermined period.

At S310, the vehicle-side controller 16 acquires various information from the RAM, and the various information includes the vehicle information and the driver reaction time. The process at S310 may be performed by a reaction time acquiring section provided in the vehicle-side controller 16. At S320, the vehicle-side controller 16 determines whether the traveling speed of the subject vehicle is greater than the speed limit of the road on which the subject vehicle travels.

When the traveling speed of the subject vehicle is higher than the speed limit, which corresponds to "YES" at S320, the vehicle-side controller 16 sets an deceleration warning at S330. The process at S330 may be performed by a deceleration warning section provided in the vehicle-side controller 16. After S330, the process proceeds to S450.

When the traveling speed is not higher than the speed limit, which corresponds to "NO" at S320, the process proceeds to S340. At S340, the vehicle-side controller 16 determines whether the display portion 12 is warning, based on, for example, a state of a warning flag.

Figure 8:
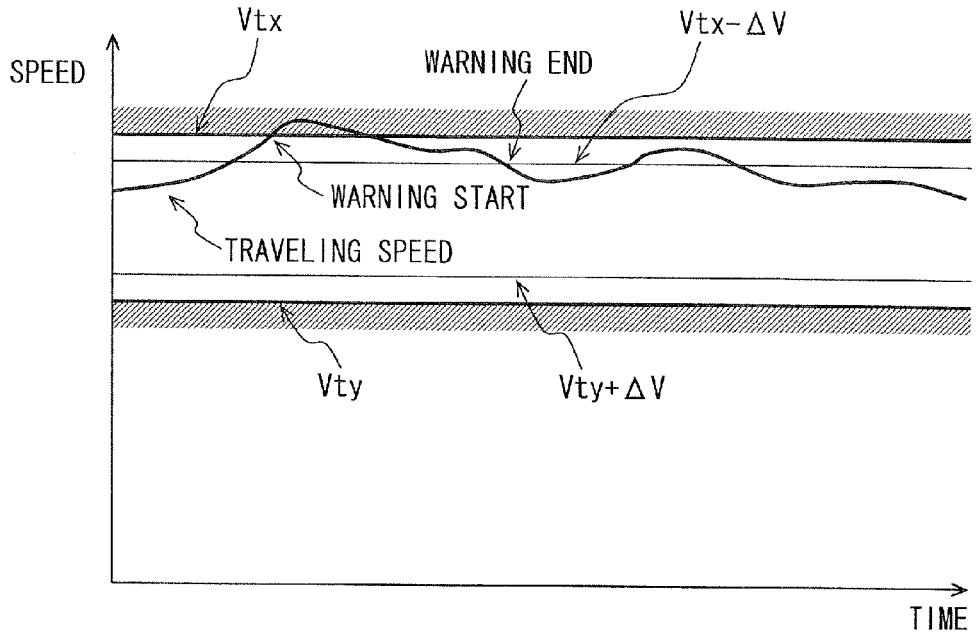
FIG. 8 is a graph showing a relationship between a warning start speed and a warning end speed.

When the display portion 12 is warning, which corresponds to "YES" at S340, the vehicle-side controller 16 sets a warning end speed at S350. The warning end speed will be described with reference to FIG. 8. As shown in FIG. 8, when the traveling speed is higher than the maximum target speed Vtx, the vehicle-side controller 16 sets the warning end speed, for example, to a speed Vtx−ΔV. When the traveling speed is lower than the minimum target speed Vty, the vehicle-side controller 16 sets the warning end speed, for example, to a speed Vty+ΔV. The speed ΔV is, for example, from about 5% to about 10% of the target speed.

At S360, the vehicle-side controller 16 compensates the warning end speed in accordance with a property of a driver. The vehicle-side controller 16 previously detects a reaction time of a driver and stores the detection result of the reaction time in a memory such as a RAM. The reaction time is, for example, a time from when the in-vehicle device 1 outputs a warning to a driver to when the driver performs an operation corresponding to the warning. The vehicle-side controller 16 compensates the warning end speed so that the speed of the subject vehicle becomes the uncompensated warning end speed after the reaction time if the present operation state (an operation of acceleration or deceleration) is continued.

In other words, in a case where the vehicle-side controller 16 outputs a warning when the traveling speed of the subject vehicle is the compensated warning end speed, after the reaction time when the driver reacts to the warning, the traveling speed becomes the uncompensated warning end speed.

At S370, the vehicle-side controller 16 determines whether the display portion 12 should end the warning. In other words, the vehicle-side controller 16 determines whether the traveling speed of the subject vehicle is equal to the warning end speed. If the traveling speed is equal to the warning end speed, which corresponds to "YES" at S370, the vehicle-side controller 16 sets the warning end at S380, and the vehicle-side controller 16 turns off the warning flag.

If the display portion 12 should not end the warning, which corresponds to "NO" at S370, the process proceeds to S450. If the display portion 12 is not warning at S340, which corresponds to "NO" at S340, the vehicle-side controller 16 sets a warning start speed at S410. The warning start speed includes, for example, a high-side warning start speed, that is, the maximum target speed Vtx and a low-side warning start speed, that is, the minimum target speed Vty. As shown in FIG. 8, the warning start speed (Vtx or Vty) is different from the warning end speed (Vtx−ΔV or Vty+ΔV). Thus, once the warning is started, the warning is continued for a while, and once the warning is ended, the warning is not started for a while.

At S420, the vehicle-side controller 16 determines whether the display portion 12 should start warning. In other words, the vehicle-side controller 16 determines whether the traveling speed of the subject vehicle is equal to the warning start speed.

If the display portion 12 should not start warning, which corresponds to "NO" at S420, the process proceeds to S510. If the display portion 12 should start warning, which corresponds to "YES" at S420, the vehicle-side controller 16 sets a warning start at S430, the vehicle-side controller 16 turns on the warning flag at S440. At S450, the vehicle-side controller 16 sets a blinking period of the acceleration and deceleration instruction image 12*b*.

The vehicle-side controller 16 compares the traveling speed of the subject vehicle and the target speed range. When the traveling speed of the subject vehicle is higher than the target speed range or when the deceleration warning is set, the vehicle-side controller 16 sets a lighting color of the acceleration and deceleration instruction image 12*b* to red. When the traveling speed of the subject vehicle is lower than the target speed range, the vehicle-side controller 16 sets the lighting color of the acceleration and deceleration instruction image 12*b* to green. Furthermore, the vehicle-side controller 16 sets the blink period in such a manner that the blink period increases with a difference between the traveling speed of the subject vehicle and the target speed (speed limit).

For example, the vehicle-side controller 16 may set the blinking period within a range from 0.5 Hz to 2.0 Hz so as to reduce a possibility that a driver mistakes the blinking of the acceleration and deceleration instruction image 12*b* for continuous lighting or a driver is annoyed by the blinking.

At S510, the vehicle-side controller 16 outputs a control signal to the display portion 12 so that the display portion 12 displays the acceleration and deceleration instruction image 12*b* based on the setting, and then the vehicle-side controller 16 ends the warning process. When the vehicle-side controller 16 displays nothing on the display portion 12, the process at S510 may be omitted. When the control signal is transmitted from the vehicle-side controller 16 to the display portion 12, the acceleration and deceleration instruction image 12*b* is lighted up or blinks on the condition set by the vehicle-side controller 16.

In the driver assistance system 100, the roadside controller 23 in the roadside device 6 transmits the traffic signal information including the current and future lighting colors and the lighting times of respective lighting colors of a specific traffic signal to the vehicle. The vehicle-side controller 16 in the in-vehicle device 1 calculates the target speed range to enable the subject vehicle to enter an intersection on a green light based on the traffic signal information received from the roadside device 6 and the intersection distance between the subject vehicle and the intersection at which the traffic signal is located. Then, the vehicle-side controller 16 outputs the target speed range.

The driver assistance system 100 can calculate the target speed range to enable the subject vehicle to enter an intersection on a green light and can output the target speed range. Thus, by controlling the speed of the subject vehicle within the target speed range, the subject vehicle can enter the intersection on the green light. As a result, the driver assistance system 100 can contribute to improve fuel consumption and to reduce traffic jams.

In the driver assistance system 100, the vehicle-side controller 16 outputs the warning to a driver of the subject vehicle based on the target speed. Thus, the driver can control the subject vehicle so that the subject vehicle travels at the target speed.

The vehicle-side controller 16 warns in accordance with the difference between the traveling speed of the subject vehicle and the target speed with the display portion 12 that can display the acceleration and deceleration instruction image 12*b*. Thus, the vehicle-side controller 16 can visually inform the driver of the difference between the traveling speed of the subject vehicle and the target speed. Thus, compared with a configuration that informs a driver of a target speed with audio, the in-vehicle device 1 can inform with a simple configuration.

In the driver assistance system 100, the vehicle-side controller 16 shortens the blinking period of the acceleration and deceleration instruction image 12*b* with increasing the difference between the traveling speed of the subject vehicle and the target speed.

Because the driver assistance system 100 can inform a driver of the difference between the traveling speed of the subject vehicle and the target speed with the blinking period of the acceleration and deceleration instruction image 12*b*, the driver can recognize the blinking of the acceleration and deceleration instruction image 12*b* with a part of a visual field without looking at the light-emitting part carefully. Therefore, the driver can sensuously recognize the difference between the traveling speed of the subject vehicle and the target speed.

The vehicle-side controller 16 ends the warning before the difference between the traveling speed of the subject vehicle and the target speed becomes zero. Thus, the driver assistance system 100 can restrict overshooting and undershooting in which the traveling speed exceeds the target speed due to a reaction delay of a driver or a control delay of the subject vehicle.

The vehicle-side controller 16 acquires the reaction time from when the vehicle-side controller 16 outputs a warning to when the driver of the subject vehicle performs an operation corresponding to the warning and ends the warning when the vehicle-side controller 16 estimates that the difference between the traveling speed of the subject vehicle and the target speed will become zero after the reaction time.

Because the driver assistance system 100 can learn a property of a reaction time of a driver in advance, the driver assistance system 100 can end the warning at an appropriate time in accordance with the property of the driver.

The vehicle-side controller 16 acquires information about a speed limit of a road on which the subject vehicle travels. When the traveling speed of the subject vehicle is higher than the speed limit, the vehicle-side controller 16 prohibits the warning based on the difference between the traveling speed of the subject vehicle and the target speed and executes the deceleration warning for prompting a driver to decelerate the subject vehicle.

Thus, the driver assistance system 100 can prompt a driver to drive the subject vehicle within the speed limit. The vehicle-side controller 16 acquires the intersection distance calculated based on the intersection distance included in the information acquired before through the light beacon receiver 34 and the traveling distance of the subject vehicle.

Because the driver assistance system 100 acquires the intersection distance calculated based on the information from the light beacon having a high position accuracy, the driver assistance system 100 can improve the accuracy of calculating the target speed.

Furthermore, the vehicle-side controller 16 acquires the intersection distance calculated based on the information including the latitude and the longitude of the intersection at which the traffic signal is located and the latitude and the longitude of the current position of the subject vehicle.

Thus, the driver assistance system 100 can calculate the intersection distance even when the driver assistance system 100 cannot acquire the information from the light beacon. The vehicle-side controller 16 also acquires the information about presence or absence of a front vehicle traveling ahead of the subject vehicle. When there is a front vehicle traveling ahead of the subject vehicle, the vehicle-side controller 16 does not output a target speed range higher than a traveling speed of the front vehicle.

Thus, the driver assistance system 100 can restrict the subject vehicle from approaching other vehicle traveling ahead of the subject vehicle. As a result, the driver assistance system 100 can secure safety between the subject vehicle and other vehicle traveling ahead of the subject vehicle.

The vehicle-side controller 16 does not output a target speed range higher than the speed limit. Because the driver assistance system 100 does not output a target speed higher than the speed limit, the driver assistance system 100 can restrict the subject vehicle from traveling at a speed higher than the speed limit.

The vehicle-side controller 16 does not output a target speed range lower than a predetermined minimum speed. Thus, the driver assistance system 100 can restrict the subject vehicle from traveling at a low speed and obstructing traveling of other vehicle.

In a case where the vehicle approaches the intersection in transition of the lighting color from red to green, the vehicle-side controller 16 calculates the target speed range to enable the vehicle to arrive at a position at a predetermined distance short of the traffic signal when the lighting color turns to green, and the predetermined distance depends on the traveling speed of the subject vehicle.

Because the driver assistance system 100 can control the subject vehicle so that the lighting color of the traffic signal turns to green when the subject vehicle arrives at a position at the predetermined distance short of the traffic signal, the driver assistance system 100 can restrict the anxiety of a driver that the subject vehicle may enter the intersection on a red light. Furthermore, because the driver assistance system 100 guides the driver so that the traffic signal turns to green when the subject vehicle is at a position sufficiently in front of a stop line, the driver assistance system 100 guides the driver so that the traffic signal turns to green when the subject vehicle is at a position sufficiently short of a stop line, the driver assistance system 100 can restrict the subject vehicle from entering the intersection on a red light.

Although the present invention has been fully described in connection with the preferred embodiments thereof with reference to the accompanying drawings, it is to be noted that various changes and modifications will become apparent to those skilled in the art.

In the driver assistance system 100 according to the above-described embodiment outputs the warning in accordance with the target speed as an example. The driver assistance system 100 may also be configured to automatically drive the subject vehicle based on the target speed. The driver assistance system 100 may also perform the above-described warning process and the automatic driving based on the target speed in parallel.

What is claimed is:

1. A driver assistance device to be disposed in a vehicle for assisting a driving operation by a driver of the vehicle, comprising:

a traffic signal information acquiring section configured to acquire traffic signal information that includes current and future lighting colors and lighting times of respective lighting colors of a traffic signal located in a traveling direction of the vehicle;

an intersection distance acquiring section configured to acquire an intersection distance between the vehicle and an intersection at which the traffic signal is located;

an entering speed calculating section configured to calculate an entering speed range to enable the vehicle to enter the intersection in a state where the lighting color of the traffic signal is green;

an outputting section configured to output the entering speed range;

a speed acquiring section configured to acquire a traveling speed of the vehicle;

a first warning section configured to compare the traveling speed of the vehicle with a target speed set within the entering speed range and to output a warning when there is a difference between the traveling speed and the target speed; and a reaction time acquiring section configured to acquire a reaction time from when the first warning section outputs the warning to when the driver performs an operation corresponding to the warning, wherein the first warning section is configured to end the warning when the first warning section, determines that the traveling speed of the vehicle will converge to the target speed after an amount of time corresponding to a stored reaction time has elapsed, before the traveling speed of the vehicle actually converges to the target speed.

2. The driver assistance device according to claim 1, wherein the first warning section is configured to output the warning using a light-emitting part that is capable of lighting a predetermined image or a predetermined light-emitting body in accordance with the difference between the traveling speed of the vehicle and the target speed.

3. The driver assistance device according to claim 2, wherein the first warning section is configured to shorten a blinking period of the light-emitting part with increasing the difference between the traveling speed of the vehicle and the target speed.

4. The driver assistance device according to claim 1, further comprising:

a speed limit acquiring section configured to acquire a speed limit of a road on which the vehicle travels; and a second warning section configured to prohibit the warning by the first warning section and to output a warning for prompting deceleration of the vehicle when the traveling speed is higher than the speed limit.

5. The driver assistance device according to claim 1, further comprising a traveling distance acquiring section configured to detect a traveling distance of the vehicle, wherein the intersection distance acquiring section includes a beacon acquiring section configured to acquire the intersection distance that is calculated based on an intersection distance included in information acquired previously through a light beacon receiver and a detection result by the traveling distance acquiring section.

6. The driver assistance device according to claim 1, wherein the intersection distance acquiring section includes a latitude and longitude acquiring section configured to acquire the intersection distance calculated based on information including a latitude and a longitude of the intersection at which the traffic signal is located and a latitude and a longitude of a current position of the vehicle.

7. The driver assistance device according to claim 1, wherein in a case where the entering speed calculating section calculates the entering speed range to enable the vehicle to enter the intersection in transition of the lighting color from red to green, the entering speed calculating section calculates the entering speed range so that an entering speed at which the vehicle arrives at a position at a predetermined distance short of the traffic signal when the lighting color turns to green becomes an upper limit of the entering speed range, and the predetermined distance depends on the traveling speed of the vehicle.

8. The driver assistance device according to claim 1, further comprising:

a front vehicle acquiring section configured to acquire information about presence or absence of a front vehicle that travels ahead of the vehicle and a traveling speed of the front vehicle; and a first prohibiting section configured to prohibit the outputting section from outputting the target speed higher than the traveling speed of the front vehicle.

9. The driver assistance device according to claim 1, further comprising:

a speed limit acquiring section configured to acquire information about a speed limit of a road on which the vehicle travels, and a second prohibiting section configured to prohibit the outputting section from outputting the target speed higher than the speed limit.

10. The driver assistance device according to claim 1, further comprising:

a third prohibiting section configured to prohibit the outputting section from outputting the target speed lower than a predetermined minimum speed.

11. A driver assistance device to be disposed in a vehicle for assisting a driving operation by a driver of the vehicle, comprising:

a speed acquiring section configured to acquire a traveling speed of the vehicle;

a warning section configured to compare the traveling speed of the vehicle with a target speed set in an entering speed range that indicates a range of a traveling speed to enable the vehicle to enter an intersection in a state where a lighting color of a traffic signal located in a traveling direction of the vehicle is green and to output a warning when there is a difference between the traveling speed and the target speed; and a reaction time acquiring section configured to acquire a reaction time from when the warning section outputs the warning to when the driver performs an operation corresponding to the warning, wherein the warning section is configured to end the warning when the warning section determines that the traveling speed of the vehicle will converge to the target speed after an amount of time corresponding to a stored reaction time has elapsed, before the traveling speed of the vehicle actually converges to the target speed.

12. A driver assistance system for assisting a driving operation by a driver of a vehicle, comprising an in-vehicle device and a roadside device that is communicable with the in-vehicle device, wherein the roadside device includes a traffic signal information transmitting section configured to transmit a traffic signal information that includes current and future lighting colors and lighting times of respective lighting colors of a predetermined traffic signal to the vehicle, and wherein the in-vehicle device is configured as the driving assistance device according to claim 1.

13. The driver assistance device according to claim 1, wherein the reaction time acquiring section is further configured to store a previously detected reaction time of the driver, to enable the first warning section to determine when the traveling speed of the vehicle will converge to the target speed, without requiring a presently detected reaction time from the reaction time acquiring section.

14. The driver assistance device according to claim 1, wherein the first warning section is configured to output the warning when there is a difference between the traveling speed and the target speed based on a warning start speed range between a high-side warning start speed and a low-side warning start speed.

15. The driver assistance device according to claim 11, wherein the reaction time acquiring section is further configured to store a previously detected reaction time of the driver, to enable the warning section to determine when the traveling speed of the vehicle will converge to the target speed, without requiring a presently detected reaction time from the reaction time acquiring section.

16. The driver assistance device according to claim 11, wherein the warning section is configured to output the warning when there is a difference between the traveling speed and the target speed based on a warning start speed range between a high-side warning start speed and a low-side warning start speed.

* * * * *